US005688057A

United States Patent [19]

Wright et al.

[11] Patent Number: 5,688,057

[45] Date of Patent: Nov. 18, 1997

[54] METHOD OF PRINTING USING DUAL OPPOSING PRINTHEADS

[75] Inventors: Christopher B. Wright, San Francisco; Alan Chris Allison, Pacifica, both of Calif.

[73] Assignee: Twigs, Inc., Los Angeles, Calif.

[21] Appl. No.: 539,846

[22] Filed: Oct. 6, 1995

Related U.S. Application Data

[62] Division of Ser. No. 67,291, May 25, 1993, Pat. No. 5,456,539.

[51] Int. Cl.[6] ..... B41J 3/60

[52] U.S. Cl. ..... 400/82; 400/188

[58] Field of Search ..... 400/82, 149, 188, 400/189; 162/134, 137; 101/490, 494

[56] References Cited

U.S. PATENT DOCUMENTS

| | | | |
|---|---|---|---|
| 1,562,431 | 11/1925 | Ananson | 400/189 |
| 2,390,554 | 12/1945 | Plum | 400/82 |

FOREIGN PATENT DOCUMENTS

| | | | |
|---|---|---|---|
| 61-192572 | 8/1986 | Japan | 400/188 |
| 62-113571 | 5/1987 | Japan | 400/188 |
| 63-104842 | 5/1988 | Japan | 400/188 |
| 1-174445 | 7/1989 | Japan | 400/188 |
| 2-182477 | 7/1990 | Japan | 400/188 |
| 3-051149 | 3/1991 | Japan | 400/188 |
| 4-189167 | 7/1992 | Japan | 400/188 |
| 5-131659 | 5/1993 | Japan | 400/188 |

*Primary Examiner*—David A. Wiecking
*Attorney, Agent, or Firm*—Leighton K. Chong

[57] ABSTRACT

A printer has dual opposing printheads which can print in tandem on two sides of paper fed along a printing plane. The dual opposing printheads can print the same information on each side of two paper sheets fed in back-to-back (two-ply) fashion, thereby providing a document and copy simultaneously. The printer can also print different information on two sides of the same paper sheet or on each side of two paper sheets, thereby doubling the printing speed as compared to a single printhead. In a preferred embodiment, the dual opposing printheads are mounted in carriages driven reciprocatingly in tandem by one drive belt. Tandem paper feed mechanisms are arranged at one side of the printer and have respective clutch spring devices which are actuated alternately by cam surfaces on the printhead carriages so as to drive a pair of paper feed rollers with the paper fed in between them. Due to the capability for two-sided printing and elimination of the need for making carbon copies, the printer can use quiet, lightweight inkjet printheads for printing with double the usual output printing speed, as well as employ new types of one and two-ply plain paper printer forms.

6 Claims, 6 Drawing Sheets

L

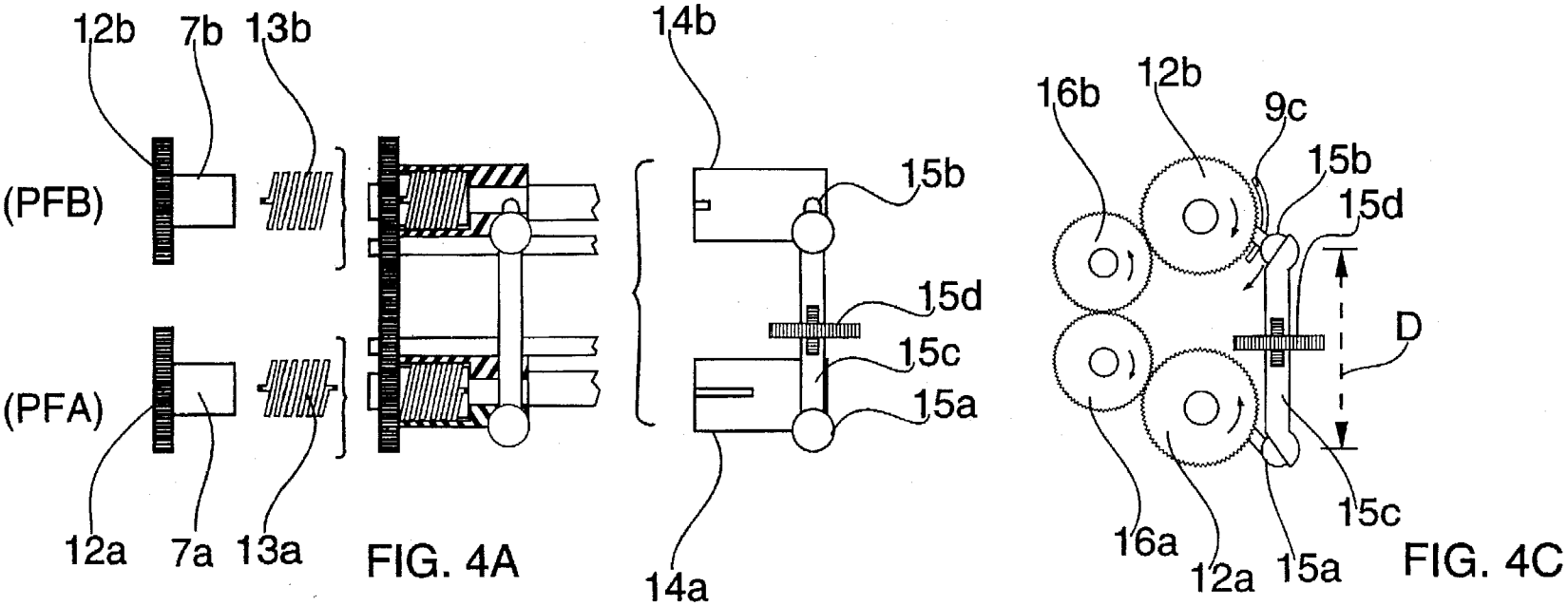
FIG. 4C
FIG. 4A
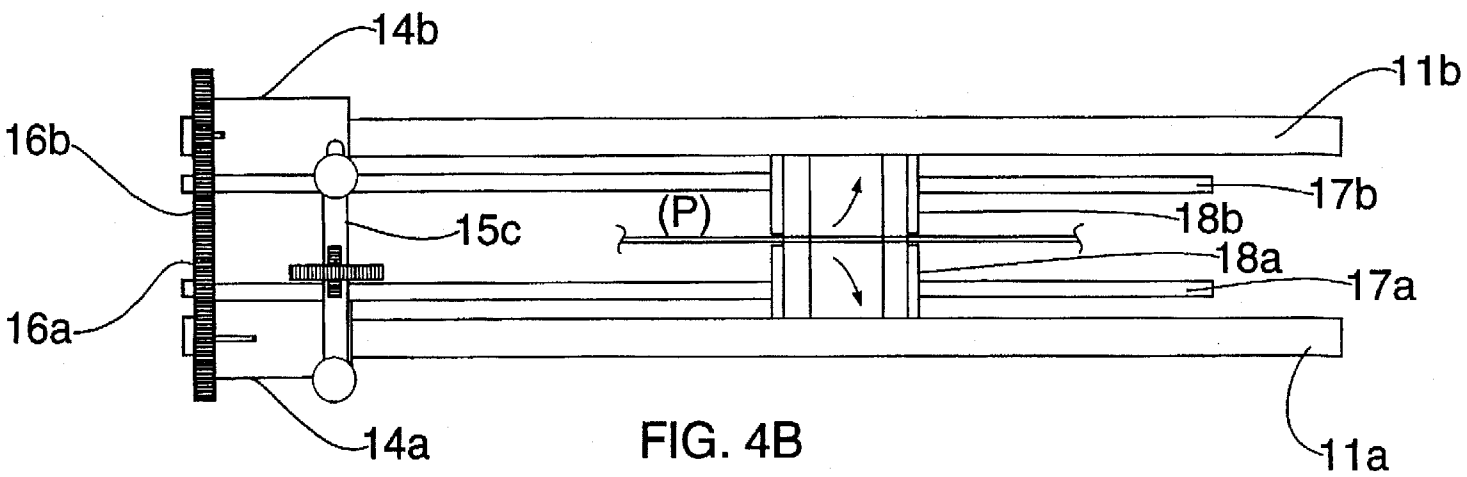
FIG. 4B

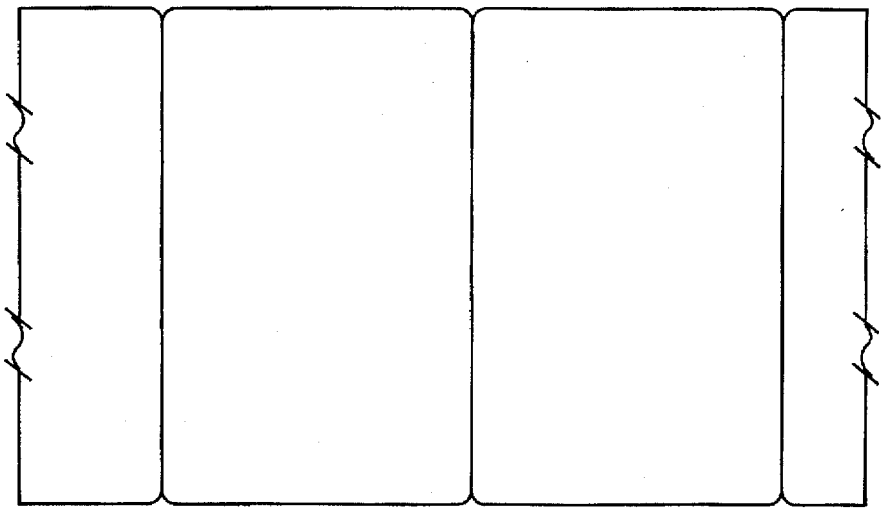
FIG. 8B
FIG. 8A
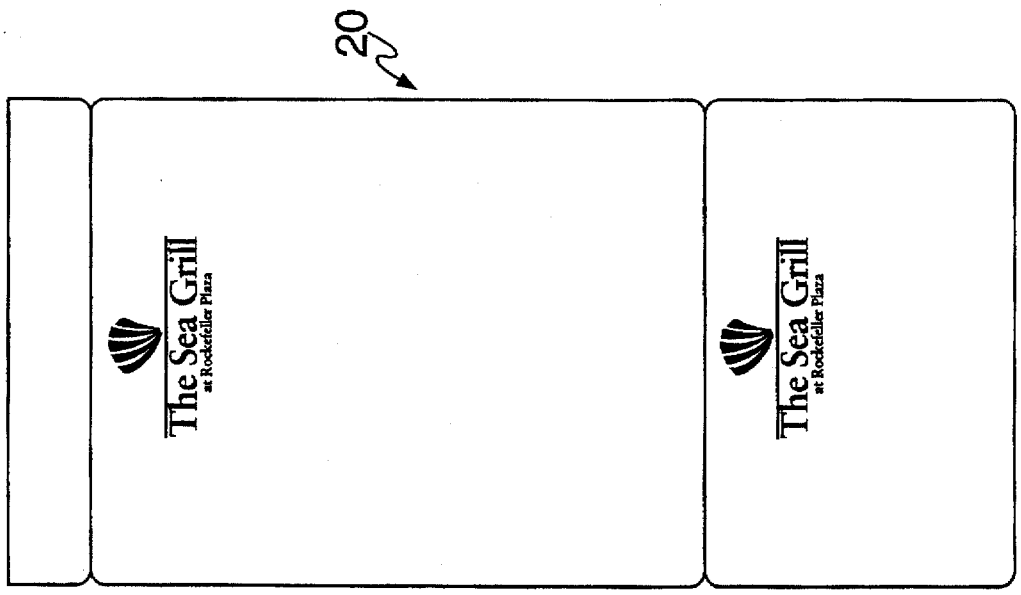
FIG. 7B
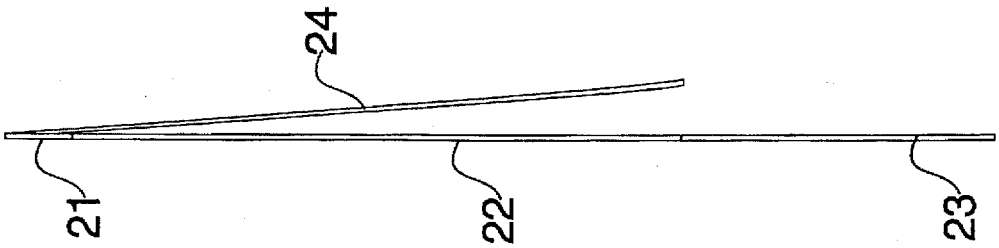
FIG. 7A

METHOD OF PRINTING USING DUAL OPPOSING PRINTHEADS

This patent application is a divisional application filed under 37 C.F.R. 1.60 by the same inventors from the prior application Ser. No. 08/067,291 filed May 25, 1993, entitled "PRINTER WITH DUAL OPPOSING PRINTHEADS", now issued as U.S. Pat. No. 5,456,539 in Oct. 10, 1995.

FIELD OF THE INVENTION

This invention generally relates to a printer apparatus, and particularly to a printer with dual opposing printheads.

BACKGROUND ART

Computers are being applied increasingly to uses outside of an office, for example, for notebook computers, portable digital devices, and point-of-sale transaction processing. Accordingly, it is desirable to make printers smaller, lighter, and more functional so that printed documents can be conveniently obtained from printers accompanying such external uses.

For some types of point-of-sale transaction processing, a document and a copy must be made at the same time, for example, for credit card transactions where an original of a charge slip is retained by the vendor and a copy is provided to the purchaser. Such document copies are conventionally obtained by using impact printers and paper with a carbon copy sheet supplied in tandem. Such carbon copies can become messy with spurious impressions, and impact printers are noisy and provide a low-grade image compared to other types of printers. On the other hand, laser printers require a laser imaging engine which is rather bulky and heavy and are therefore not convenient for portable or point-of-sale uses. Inkjet printers are quiet and lightweight but are comparatively slow.

SUMMARY OF THE INVENTION

In accordance with the present invention, a printer has dual opposing printheads which can print on two sides of a printing plane in tandem. The dual opposing printheads can print the same information on each side of two paper sheets fed in back-to-back (two-ply) fashion, thereby providing a document and copy simultaneously. The requirement for impact printing to make a carbon copy is thus eliminated, and inkjet printheads may be used instead to print two originals on plain paper stock. The printer can also print different information on two sides of the same paper sheet in duplex printing, or on each side of two paper sheets in single-sided printing, thereby doubling the printing speed in both cases as compared to a single printhead.

In the preferred embodiment, the dual opposing printheads are arranged on printing paths in parallel and are mounted in carriages driven by a drive belt so that they are reciprocated in tandem opposite to each other. A paper feed mechanism is arranged at one side of the printer and has a pair of clutch spring devices arranged in tandem which are actuated alternately by cam surfaces on the printhead carriages so as to drive a pair of paper feed rollers with the paper fed in between them. Due to the capability for two-sided printing and elimination of the need for making carbon copies, the printer can employ a wide range of one and two-ply plain paper printer forms which are more convenient to handle and can be printed with a high-grade image.

Other objects, features and advantages of the present invention are described in detail below in conjunction with the drawings, as follows:

BRIEF DESCRIPTION OF THE DRAWINGS

FIG. 4A is an assembly view of an embodiment of a paper feed assembly with clutch spring devices arranged in tandem, FIG. 4B is a plan view showing the paper feed assembly and paper feed rollers, and FIG. 4C is a schematic drawing showing the operation of the tandem clutch spring devices.

FIGS. 7A and 7B shows a two-ply, composite billing/slip printer form for manual or continuous feeding.

FIGS. 8A and 8B shows a single-ply, card or ticket printer form for continuous feeding.

DETAILED DESCRIPTION OF THE INVENTION

Figure 1:
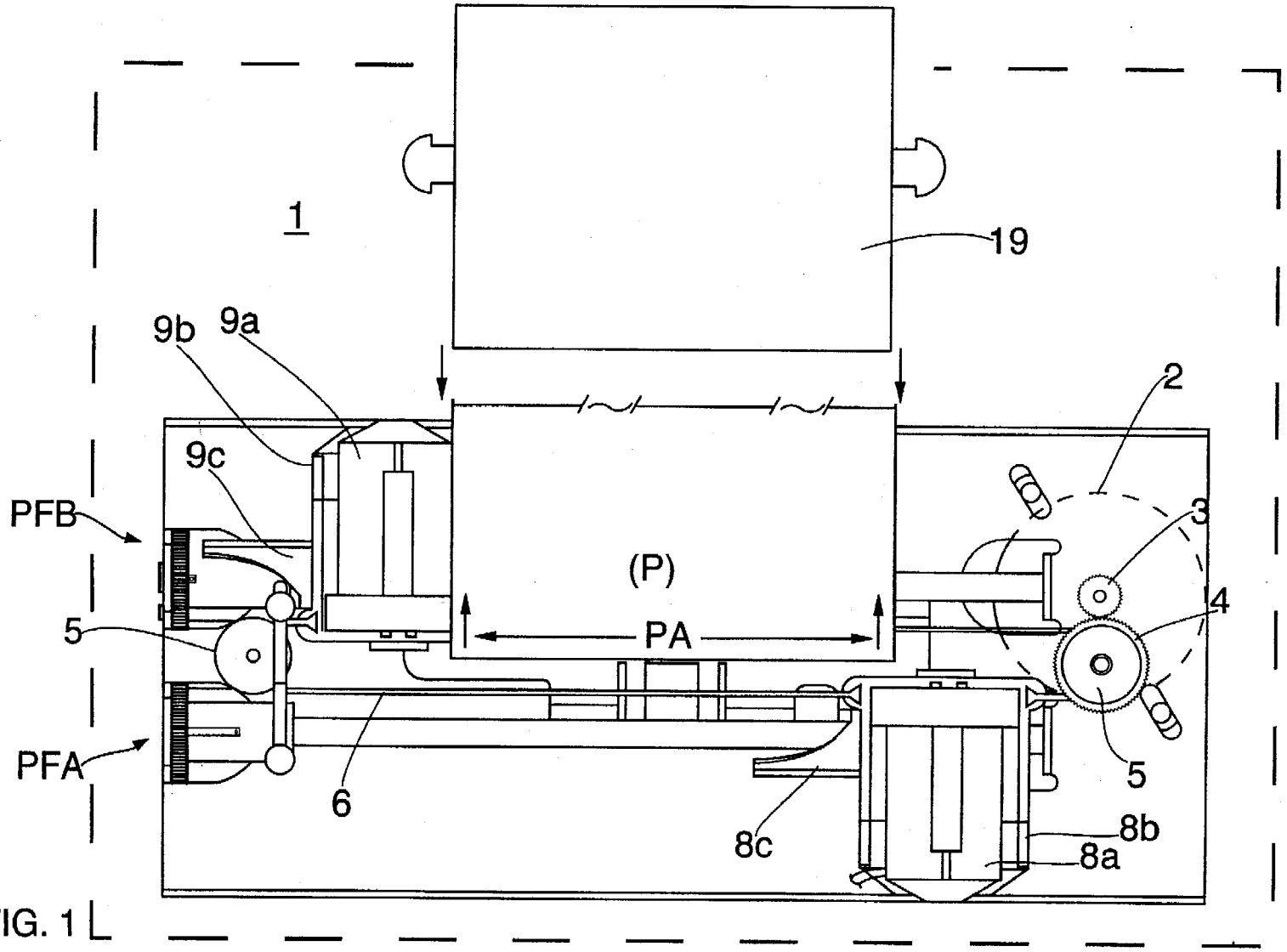
FIG. 1 is a schematic plan view of a printer having dual opposing printheads in accordance with the present invention.

Referring to FIG. 1, a printer in accordance with the present invention has a chassis 1 containing dual opposing printheads 8*a*, 9*a* mounted on respective carriages 8*b*, 9*b* for printing on opposite sides of single- or two-ply paper P having a printing area PA. The paper P may be fed manually with individual printer forms or continuously from a supply roll 19 through a paper feed mechanism (to be described in more detail below). The dual printheads and carriages are driven in opposing reciprocation by a drive belt or cable 6 entrained around pulleys 5 at opposite lateral sides of the printer. The printhead carriages 8*b*, 9*b* reciprocate along respective carriage guide bars 11*a*, 11*b*. The pulley 5 shown at the right side of FIG. 1 is connected to a drive gear 4 which is in mesh with motor pinion gear 3 of a drive motor 2.

Figure 2:
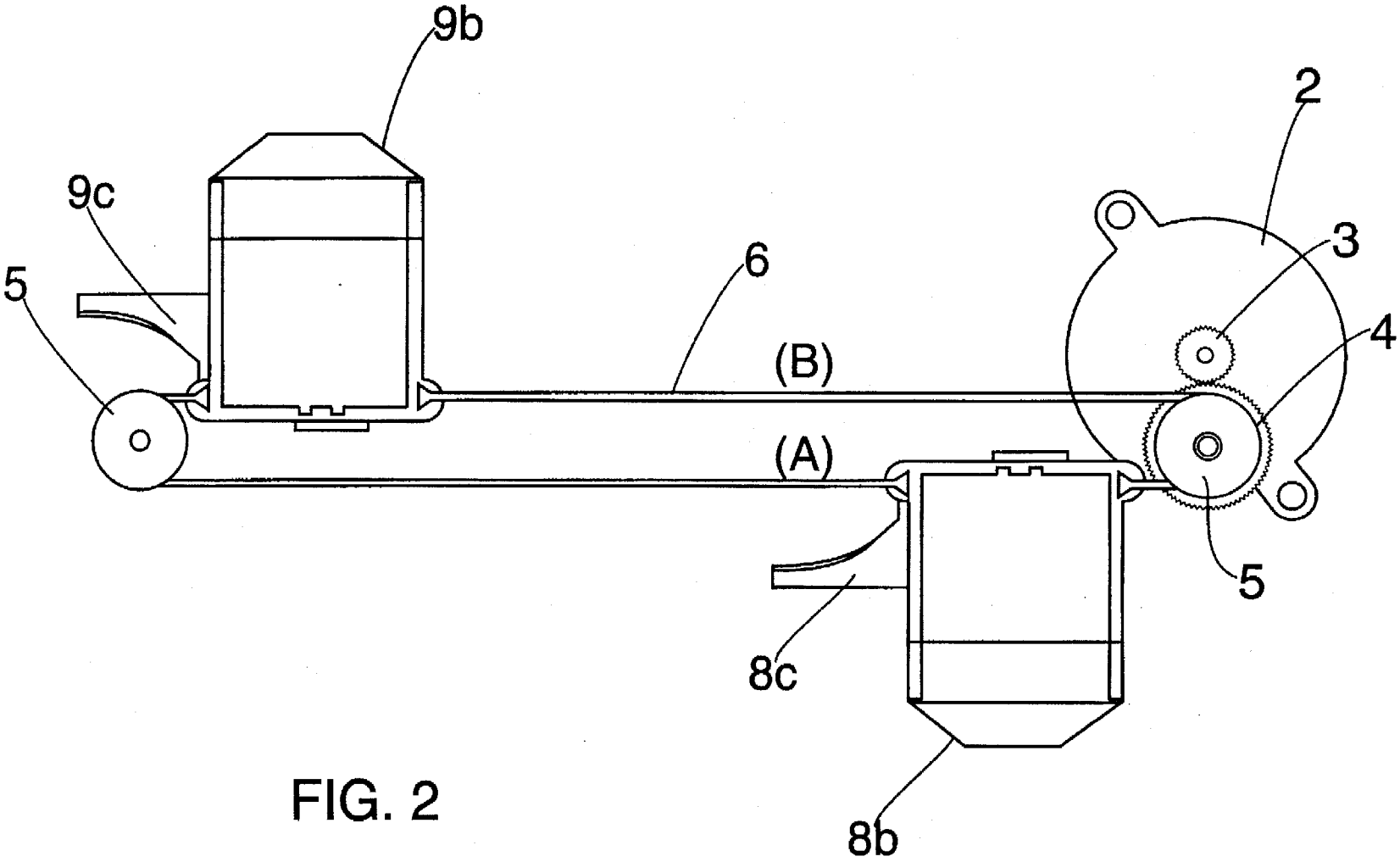
FIG. 2 is a detailed view of an embodiment of the carriage and belt drive assembly for the dual opposing printheads.
Figure 3A:
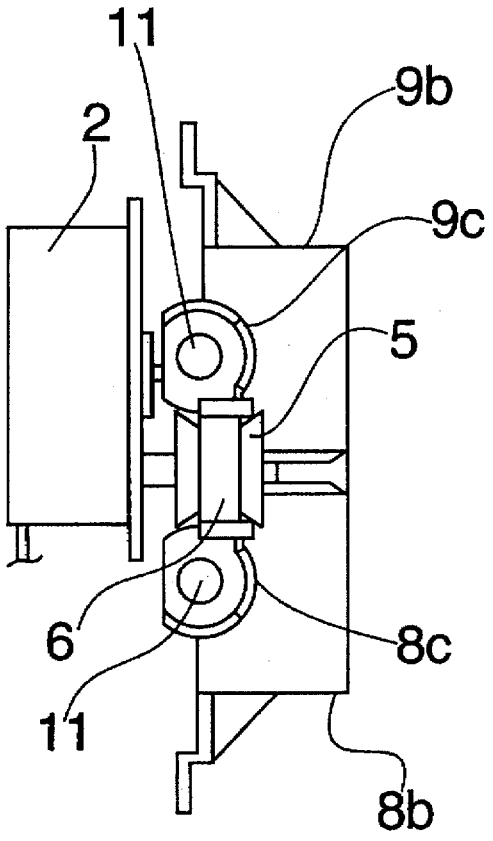
FIG. 3A is a left-side view and FIG. 3B is a right-side view of the carriage and belt drive assembly.
Figure 3B:
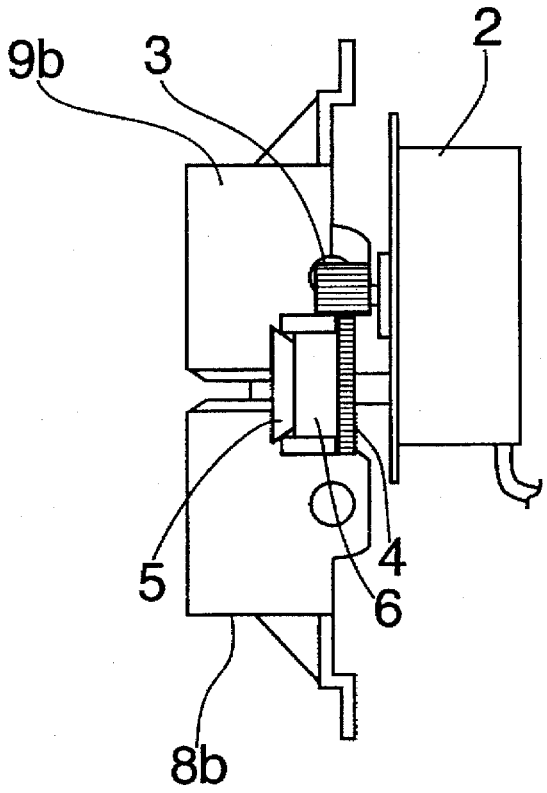

The printhead drive assembly is shown in more detail in FIGS. 2, 3A, and 3B. The printheads 8*a*, 9*a* are shown in their end-of-travel positions (beyond the printing area PA) for actuating the paper feed mechanisms PFA, PFB. The drive belt 6 has two belt sections A, B with connector elements at their ends coupled to the printhead carriages 8*b*, 9*b* for driving them in reciprocation along the respective printing paths in parallel with each other. The connector elements may be removable from the carriages in order to allow replacement of the belt sections when they become worn. The carriages 8*b*, 9*b* have respective paper feed pushers 8*c*, 9*c* with cam surfaces formed thereon for actuating a respective one of the paper feed mechanisms PFA, PFB (described below). A control cable connects the motor 2 to a printer control board (not shown).

In FIGS. 4A to 4C, the paper feed mechanisms PFA, PFB are shown in greater detail having respective paper advance gears 12*a*, 12*b* fixedly connected to shafts 7*a*, 7*b*, clutch springs 13*a*, 13*b* for gripping and releasing the shafts, and clutch sleeves 14*a*, 14*b* coupled to the clutch springs (via slots for retaining the spring ends) and sleeved over the clutch springs and shafts of the advance gears. These elements are arranged at the left-hand ends of the carriage guide bars 11*a*, 11*b*. The clutch sleeves 14*a*, 14*b* have respective pusher bars 15*a*, 15*b* rigidly connected to them at predetermined angular positions, and a connecter bar 15*c* connects the ends of the pusher bars together so as to maintain them a given distance D apart. The paper advance gears 12*a*, 12*b* are in mesh with respective paper feed drive gears 16*a*, 16*b*. The drive gears 16*a*, 16*b* are also in mesh with each other, and are fixedly coupled to respective paper feed axles 17*a*, 17*b* on which paper feed rollers 18*a*, 18*b* are mounted to apply a nip pressure to the paper P fed in between them.

The operation of the tandem paper feed mechanisms is described specifically with respect to FIG. 4*c*. For this description, the printhead carriage 9*b* at the upper side of the printer in FIG. 1 is assumed to be moving to its end-of-travel position for actuating the upper paper feed mechanism PFB. As the carriage 9*b* approaches the upper paper feed mechanism PFB, the cam surface of the paper feed pusher 9*c* pushes the upper pusher bar 15*b* (in the direction of the downward arrow in FIG. 4C) so as to rotate the upper clutch sleeve 14*b* in a clockwise direction which, due to tightening of the clutch spring 13*b* around the shaft 7*b*, turns the upper paper advance gear 12*b* clockwise and the meshed drive gear 16*b* counter-clockwise. The upper feed roller 18*b* on the feed axle 17*b* coupled to the upper drive gear 16*b* therefore rotates counterclockwise to advance the paper P (in a vertical direction relative to the plane of the figure).

Meanwhile, the connector bar 15*c* pushes the pusher bar 15*a* also in the downward direction and rotates the lower clutch sleeve 14*a* in the clockwise direction. However, because the lower clutch spring 13*a* is arranged in the opposite tightening direction from the clutch spring 13*b*, the clockwise movement of the lower clutch sleeve 14*a* causes the clutch spring 13*a* to loosen from the lower shaft 7*a*, thereby releasing the lower paper advance gear 12*a*, drive gear 16*a*, feed axle 17*a*, and feed roller 18*a* to follow the movement of the upper drive gear 16*b* and feed roller 18*b*.

The other printhead carriage 9*a* at this time is located at the end-of-travel position at the opposite (right-hand) side of the printer where it does not engage the lower paper feed mechanism PFA. On the next reciprocation cycle, the lower printhead carriage 9*a* will move to its end-of-travel position for actuating the lower paper feed mechanism PFA, while the upper printhead carriage 9*b* is moved away to the right-hand side. Actuation of the lower paper feed mechanism PFA by the cam surface of the pusher 8*c* connected to the printhead carriage 8*b* causes the lower clutch sleeve 14*a* to tighten the clutch spring 13*a* on the shaft 7*a* and the paper advance gear 12*a* to rotate counter-clockwise, thereby rotating the lower drive gear 16*a* and feed roller 18*a* in the clockwise direction to advance the paper, while the upper drive gear 16*b* and feed roller 18*b* are released to follow in rotation.

This tandem arrangement of the paper feed mechanisms PFA, PFB thus causes the paper P to be advanced by one line feed increment on each reciprocation of one of the printhead carriages to the left-hand side of the printer. The paper feed assembly at the left-hand side provides a reliable paper feeding function based upon the reciprocation of the printhead carriages alone, and therefore eliminates the need for separate printer control of paper feeding. Moreover, the space taken up by the paper feed mechanisms PFA, PFB is hardly larger than end mountings for the carriage guide bars 11*a*, 11*b*, and therefore conserves space in the printer. The engagement of the paper feed mechanisms takes place at the end-of-travel positions beyond the printing area PA on the paper P. Therefore, printing never occurs while the paper is being advanced. Cleaning wicks may be provided for each printhead in the no-printing zones to keep them clear of excess ink.

The line feed increment may be adjusted by changing the angular positions of the pusher bars 15*a*, 15*b* on the clutch sleeves 14*a*, 14*b* so that the pusher bars are moved through a greater or lesser distance on each engagement with the cam surfaces of the pushers 8*c*, 9*c*. The angular positions of the pusher bars 15*a*, 15*b* can be changed together simply by lengthening or shortening the length D of the connector bar. The connector bar 15*c* may have an adjuster 15*d* of the type consisting of a thumbwheel with oppositely-threaded shaft ends which thread into the ends of opposing connector bar sections, or a telescoping section with a number of lock positions. The line feed increments may accordingly be set at two line, line-and-a-half, or single line spacing for text, or with lines (print areas) touching for graphics printing. For advancing the paper or feeding in the leading edge of individual sheets of paper manually, the printer can have a paper advance control button for activating the motor to drive the printhead carriages in reciprocation to advance the sheet to the printing position of the printheads.

The printer chassis can be manufactured from metal or EMF-shielded and grounded plastic. Printer chassis parts and individual mountings may be. incorporated as parts of the printer case molding. The motor may be of the rotary stepper type which can be driven in precise increments in both directions of rotation. The belt drive may be formed in two belt sections having their ends removably coupled to the printhead carriages, or it may be a single, endless belt with fasteners for coupling to the printhead carriages. Instead of the belt drive shown, a cable drive system may be used. The inkjet printheads 8*a*, 9*a* may be units that are sold commercially, such as by Hewlett-Packard Co., of Palo Alto, Calif. The control of inkjet printheads is wellknown in the industry and is not described in further detail herein. The printheads are connected by wire cables to a printer control board which receives input as to the information to be printed and formats the control signals to be transmitted to the printheads. The printheads can print on each movement to the left and right, and the same or different information on each side.

For example, the input information may be text data from a computer in a recognized format (such as ASCII). The printer mode may be selected for printing the same information on both sides (COPY), or different information on each side (DUPLEX). The printer control board can include RAM memory sufficient to receive a single page or two pages at a time of text data, and is suitably programmed in a conventional manner to reformat and print the text in the selected COPY or DUPLEX mode. For graphics printing, the printer control board can include a larger RAM memory sufficient to store an input file of graphics image data in standard format (such as PIF) for reformatting and printing. If the input information is transaction data to be received from an external device, such as a point-of-sale terminal; for printing within predefined fields with or without logos or other graphics, the printer control board can be programmed with the appropriate vendor graphics and formats.

Figure 6:
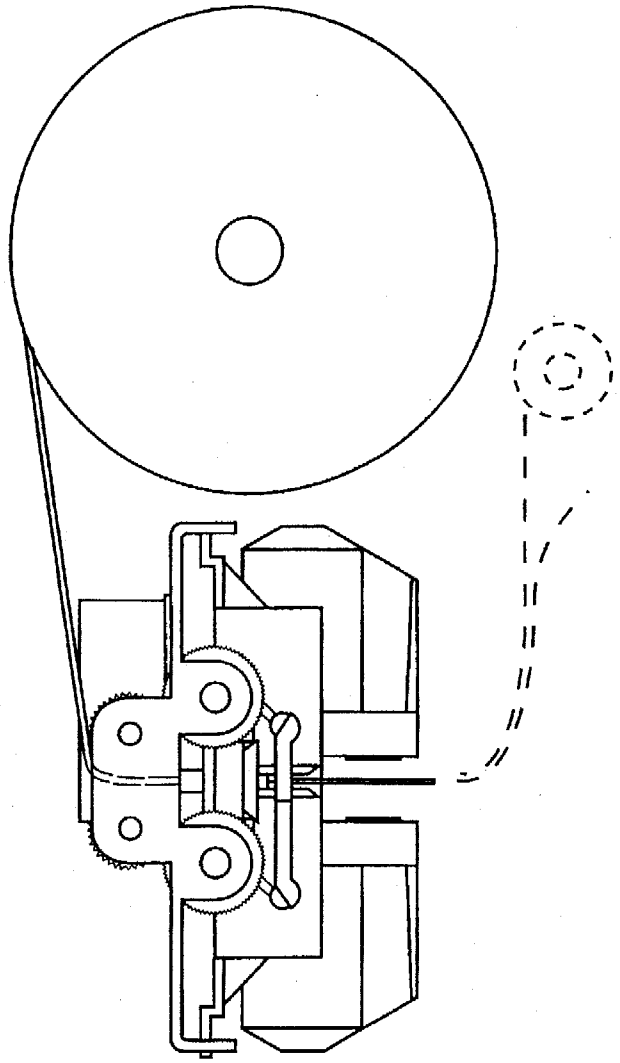
FIG. 6 illustrates the printer used for one-sided printing on two-ply paper stock supplied from a supply roll.
Figure 5:
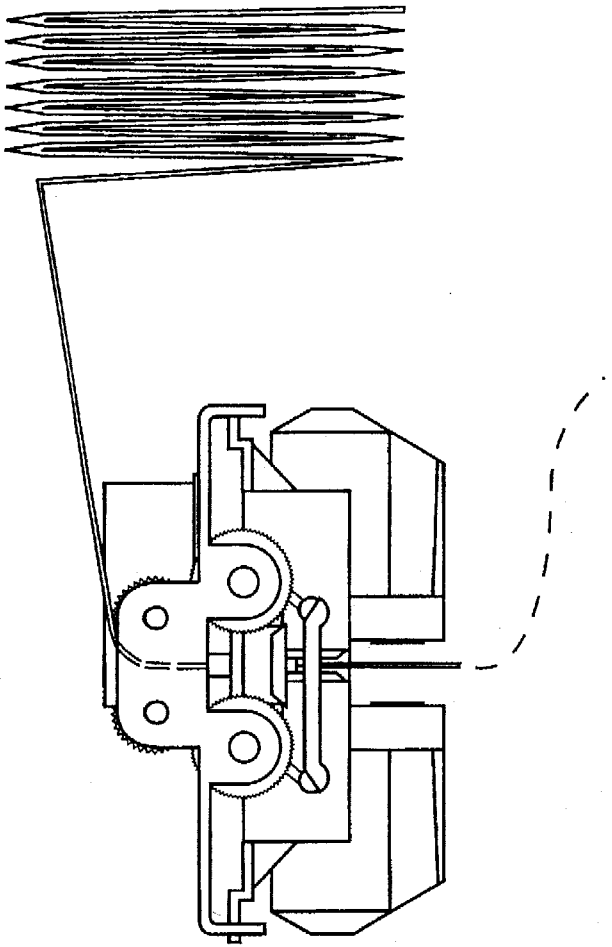
FIG. 5 illustrates the printer used for two-sided printing on fan-folded single-ply paper stock.

The printer may be configured to print in COPY or DUPLEX modes on any selected width of paper stock, such as standard-size journal paper, small card stock, or billing sheets with 3.0 to 3.5 inch width, or ticket or larger card stock with 8.5 inch widths, or letter or legal size paper with 11.0 inch widths. The advantages obtained by two-sided printing allow many new configurations of printer forms to be used. For example, FIG. 5 illustrates the printer used for printing on single-ply fan-folded paper stock in DUPLEX mode. FIG. 6 shows the printer configured for printing on two-ply paper in a COPY mode wherein the copy is conveniently wound on a take-up roll.

FIGS. 7A and 7B show a composite printer form 20 for point-of-sale use having a leading edge portion 21, a bill statement portion 22 with copy portion 24, and a customer receipt portion 23. The portions are separable from each other along scoring or perforation lines. The leading edge 21 holds the statement/receipt portion and the copy portion together as one unit and also facilitates manual feeding into the printer. The bill statement and copy portion can be used to record the details of a transaction, such as the items ordered and their prices. The copy portion may be used as an items-ordered record, whereas the bill statement-with total amount and account data for payment may be used for presenting to the customer and for the management record. The customer receipt portion 23 can be used to record the transaction totals and payment data for the customer. Thus, all required records used by a typical vendor, such as a restaurant or store, can be generated by the printer using the composite printer form.

FIGS. 8A and 8B illustrate continuous formstock for DUPLEX printing of tickets, wagering cards, coupons, etc. One side may be used to record the details of a particular transaction, while the other side may be used to print a current promotion or other information of particular interest.

Direct printing on both sides of a two-ply form allows high quality images to be generated on both documents. The low quality image and degradable carbon copy associated with conventional impact printing on credit card and point-of-sale receipt forms are thereby avoided. Many other useful and attractive types of printer form stock can be created to take advantage of the capability for printing high quality images on two document surfaces at once. The principles of the invention may also be extended to provide increased printing capacity (speed) with more than two printheads. For example, two printheads may be mounted side-by-side on each carriage on each side of the two-ply form stock, one with its printing head oriented rightside up and the other upside down, in order to print two lines or a double-thickness graphics line at the same time using the single drive mechanism.

In summary, the printer of the present invention provides a number of important advantages for small lightweight printers. The use of dual opposing printheads allows a plain paper original and copy to be printed and eliminates the need for impact printing and carbon copy sheets. Additionally, it allows duplex printing on opposite sides of single or two-ply paper, thereby doubling the output printing speed. The elimination of impact printing and doubling of printing speed allows inkjet printheads to be used, with the attendant advantages of being quiet, compact, and lightweight. Both printheads are driven by one mechanism and their reciprocation actuates the paper feed mechanism, thereby conserving space in the printer. The two-sided printing capability allows a host of new printer forms to be used for convenience and with high image quality, which is particularly advantageous for point-of-sale transactions.

Although the invention has been described with reference to certain preferred embodiments, it will be appreciated that many other variations and modifications thereof may be devised in accordance with the principles disclosed herein. The invention, including the described embodiments and all variations and modifications thereof within the scope and spirit of the invention, is defined in the following claims.

We claim:

1. A method of printing comprising the steps of:

providing a printer unit having a pair of printheads respectively arranged on opposite sides of a printing plane from each other for printing on paper fed along said printing plane, said pair of printheads being arranged on printing paths in parallel on opposite sides of said printing plane facing each other and being mounted in respective printhead carriages driven by a drive means reciprocatingly in tandem with each other;

(b) supplying paper in continuous form into the printer unit along said printing plane between said pair of printheads, said continuous form paper comprising a series of units of two-ply paper connected to each other in head-to-tail fashion, wherein two separate plies of paper of each unit are arranged in back-to-back fashion with one side of each ply facing outwardly toward a respective printhead on opposite sides of said printing plane and are connected together at leading edges thereof by a leading edge portion which is connected to a trailing end of at least one of the two plies of paper of a preceeding unit;

(c) controlling the pair of printheads so that each printhead prints on the outwardly facing one side of a respective ply of paper in tandem with each other.

2. A method for printing according to claim 1, wherein said pair of printheads are controlled to print alternate pages of information on the respective outwardly facing one sides of the two plies of paper in a duplex printing mode.

3. A method for printing according to claim 1, wherein said pair of printheads are controlled to print the same information on the respective outwardly facing one sides of the two plies of paper in a copy printing mode.

4. A method for printing according to claim 1, further comprising the step of winding up each of the two plies of paper from the printer unit on a respective one of a two take up rolls.

5. A method for printing according to claim 1, wherein in said supplying step the two plies of paper are in the form of a bill statement portion and a copy portion connected together by the leading edge portion.

6. A method for printing according to claim 5, wherein the bill statement portion includes a customer receipt portion connected to and individually separable from said bill statement portion.

* * * * *